US009695840B2

(12) United States Patent
Rabhi

(10) Patent No.: US 9,695,840 B2
(45) Date of Patent: Jul. 4, 2017

(54) REVERSIBLE HYDRAULIC PRESSURE CONVERTER EMPLOYING TUBULAR VALVES

(71) Applicant: Vianney Rabhi, Lyons (FR)

(72) Inventor: Vianney Rabhi, Lyons (FR)

( * ) Notice: Subject to any disclaimer, the term of this patent is extended or adjusted under 35 U.S.C. 154(b) by 368 days.

(21) Appl. No.: 14/461,850

(22) Filed: Aug. 18, 2014

(65) Prior Publication Data

US 2015/0053075 A1 Feb. 26, 2015

Related U.S. Application Data

(60) Provisional application No. 61/867,789, filed on Aug. 20, 2013.

(51) Int. Cl.

| | |
|---|---|
| ***F15B 13/04*** | (2006.01) |
| ***F15B 3/00*** | (2006.01) |
| ***F03C 1/007*** | (2006.01) |
| ***F15B 1/02*** | (2006.01) |
| ***F04B 9/113*** | (2006.01) |

(52) U.S. Cl.

CPC ..... *F15B 3/00* (2013.01); *F03C 1/0073* (2013.01); *F03C 1/0076* (2013.01); *F04B 9/113* (2013.01); *F15B 1/024* (2013.01)

(58) Field of Classification Search

CPC .. F15B 1/024; F15B 1/033; F15B 3/00; F04B 9/113

USPC ..... 251/129.07

See application file for complete search history.

(56) References Cited

U.S. PATENT DOCUMENTS

| | | | | |
|---|---|---|---|---|
| 2,826,149 | A * | 3/1958 | Wrigley | F04B 9/113 417/225 |
| 4,659,294 | A | 4/1987 | Barthomeuf | |
| 5,984,026 | A | 11/1999 | Baekken et al. | |
| 6,866,485 | B2 * | 3/2005 | Hansen | F04B 9/113 417/225 |
| 7,475,538 | B2 * | 1/2009 | Bishop | F15B 3/00 60/567 |
| 8,893,673 | B2 * | 11/2014 | Rabhi | F02B 75/045 251/129.05 |

FOREIGN PATENT DOCUMENTS

| | | |
|---|---|---|
| EP | 0 234 798 A2 | 9/1987 |
| FR | 2 575 792 A | 7/1986 |
| FR | 2 889 265 A1 | 2/2007 |

* cited by examiner

*Primary Examiner* — Michael Leslie
(74) *Attorney, Agent, or Firm* — Young & Thompson

(57) ABSTRACT

The reversible hydraulic pressure converter (1) employing tubular valves includes a medium-pressure stage (44) consisting of a medium-pressure cylinder (2) and a double-acting medium-pressure piston (3) the position of which is sent to a control computer of the converter (19) by a piston position sensor (14), the cylinder (2) and the piston (3) forming two medium-pressure chambers (5) that can be placed in communication with a medium-pressure inlet-outlet circuit (15) by at least one tubular valve (12), the converter (1) also including two high-pressure cylinders (9) each cooperating with a high-pressure piston (8) of smaller diameter and defining two high-pressure chambers (11) that can be placed in communication with a high-pressure inlet-outlet circuit (16) by at least one tubular valve (12), each of the various tubular valves (12) cooperating with an independent valve actuator (13).

15 Claims, 8 Drawing Sheets

1
12
44
6
2
21
12
45
A
29
B
13
3
7
5
15
8
11
E
F
40
16
G
H
10
d1
d2
14
9
C
D
4
45
18

REVERSIBLE HYDRAULIC PRESSURE CONVERTER EMPLOYING TUBULAR VALVES

FIELD OF THE INVENTION

The subject matter of the present invention is a reversible hydraulic pressure converter employing tubular valves.

BACKGROUND OF THE INVENTION

There exist various technological solutions for amplifying and/or reducing the pressure of a hydraulic circuit. Note that it is technologically more difficult to amplify or to reduce the pressure of a hydraulic flow that must be continuous than to amplify or to reduce the pressure of a hydraulic flow where a discontinuous flow is acceptable.

The dominant principle on which most pressure amplifiers or reducers rely consists in a sender piston rigidly connected to a receiver piston, said two pistons moving over the same stroke and having different sections. In this case, each piston cooperates with a cylinder and a head while the sender piston communicates with a hydraulic circuit independent of that of the receiver piston. To increase the pressure, the sender piston must have a larger section than the receiver piston, whereas to reduce said pressure the sender piston must have a section smaller than that of the receiver piston. According to this principle, the average flow rate of the hydraulic circuit at the lower pressure is greater than the average flow rate of the hydraulic circuit at the higher pressure.

The advantage of pressure amplifiers or reducers employing pistons as just described is their simplicity, their compactness, their low unit cost, and their high efficiency provided that said pistons make a good seal with the cylinder with which they cooperate. On the other hand, their principal disadvantage is their pulsed operation and, to a lesser degree, the fact that they cannot recover all of the compression energy of the hydraulic fluid, particularly on the sender piston side.

Another pressure amplifier or reducer configuration consists in a first sender rotary positive displacement hydraulic pump and a second receiver rotary positive displacement hydraulic pump having a different cubic capacity, said pumps being mounted on the same shaft or at least synchronized in rotation by a transmission of any kind. In accordance with said other configuration, the pistons of the pressure amplifiers or reducers employing pistons are replaced by said pumps, which can be of any type known to the person skilled in the art.

The advantage of pressure amplifiers or reducers employing rotary positive displacement hydraulic pumps essentially consists in improved continuity of the flow of the hydraulic fluid both on the high-pressure side and on the low-pressure side. Another advantage consists in the possibility of easier incorporation of a transmission defining different rotation ratios between the sender pump and the receiver pump. An alternative to this latter solution consists in providing for at least one of the two pumps to be of variable cubic capacity.

The problem of pressure amplifiers or reducers employing rotary positive displacement hydraulic pumps is their cost, their complexity, their overall size and their efficiency, which is generally lower than that of pressure amplifiers or reducers employing pistons.

Note that numerous pressure amplifiers or reducers employing opposed pistons intended to produce a virtually continuous flow have been patented. For example, note the published patent FR2889265, which provides a low-pressure piston referred to as the "differential piston" delimiting two low-pressure chambers and actuating two high-pressure pistons placed on respective opposite sides of said low-pressure piston, while a distributor includes a switching slide valve actuated by mechanical means actuated by the low-pressure piston, said means here being drive fingers that push on the low-pressure piston at the end of travel.

According to this configuration, each high-pressure piston constitutes, with its cylinder and with valves with which it cooperates, a high-pressure pump, the high-pressure pistons being moved in alternating longitudinal translation by the low-pressure piston, the faces of which are alternately and with opposite phase exposed to a low-pressure hydraulic pressure. It is clear that the low-pressure piston constitutes a low-pressure stage while the high-pressure pistons together produce a high-pressure stage.

It is also clear on reading the patent FR 2889265 that only pressure amplification is possible, the device providing no pressure reduction. In fact, according to said patent FR 2889265, the high-pressure stage can only be a receiver and not a driver because it in fact constitutes a pump.

Note the published patent FR2575792 which describes a hydraulic pressure amplifier functioning in an analogous manner except that the low-pressure piston has two different sections on each of its faces. In the first direction of movement of the low-pressure piston, only the smaller section face is exposed to a low-pressure hydraulic pressure while in the second direction of movement of said piston the larger section face produces an antagonistic force twice that produced by the smaller section face, said two faces remaining simultaneously exposed to the low-pressure hydraulic pressure. The result obtained is similar to that produced by the pressure amplifier employing opposed pistons protected by the patent FR 2889265. Apart from the particular configuration of its low-pressure piston, the patent FR 2575792 is distinguished from the patent FR 2889265 in that the reversing of the direction of movement of said piston is brought about by ports that said piston can block or open at the end of its stroke in order to maneuver in translation a switching slide valve, once again because of two opposed axial faces of different effective section that said slide valve exposes simultaneously or not to the low-pressure hydraulic pressure.

It is clear on reading the patent FR 2575792 that in this case also only pressure amplification is possible for reasons analogous to those that impose the same functional limitation on the device that the patent FR 2889265 describes.

The U.S. Pat. No. 5,984,026 relies on the same principle as the previous two patents, except for the detail that the switching slide valve is maneuvered both by mechanical means cooperating with the low-pressure piston and by the hydraulic pressure that exerts a force alternately on one or the other face of said slide valve which consequently moves the slide valve.

In this latter case also only pressure amplification is possible for reasons analogous to those that impose the same functional limitation on the devices described in the patents FR 2889265 and FR 2575792.

The patent EP0234798 describes other variants of the same principle and employs a low-pressure piston delimiting two low-pressure chambers to form a low-pressure stage, said piston actuating two high-pressure pistons placed on respective opposite sides of said low-pressure piston in a similar way to what is described in the previous three patents. Said patent EP0234798 this time employs a staggered low-pressure hydraulic fluid distributor that includes a primary switching slide valve actuated by mechanical means cooperating with the low-pressure piston while said slide valve controls the switching pressure applied alternately to the two axial faces of a secondary switching slide valve employing valves and valve seats.

Other variants described in the patent EP 0234798 notably consist in a switching slide valve driven in translation by a mechanical actuator the screw of which is rotated by a cable connected to the low-pressure piston.

Note that the variants of the patent EP 0234798 again relate only to the low-pressure stage of the pressure amplifier. The high-pressure stage in fact is still a hydraulic pump employing two opposed plunger pistons. These variants are therefore not reversible to enable pressure reduction, and the pressure amplifiers as described in the patents FR 2889265, FR 2575792 and U.S. Pat. No. 5,984,026 are not reversible either.

It is found that products are marketed that rely on these principles and that notably enable ultra-high-pressures to be generated from lower pressure sources. This applies, for example, to the company "Hydroprocess", which offers pressure amplifiers employing a double-acting low-pressure piston actuating two high-pressure pistons placed on respective opposite sides of said low-pressure piston, which amplifiers can be used in water jet cutting systems, for example.

Note that the devices described are therefore only pressure amplifiers and not are reversible. This is because the high-pressure stage operates only as a pump and is not equipped with a switch, while the low-pressure stage is designed only to operate as a driver, its switching device not being intended to enable said low-pressure stage to operate as a pump.

Note moreover that the high-pressure stage would with difficulty accommodate switches employing slide valves or ports as employed in the various patents described above because the ultra-high-pressures usually required mean that any leakage at the level of the slide valves or ports compromises efficiency, whether said leaks occur during the maneuver to open or block said slide valves or ports or while the slide valves or ports are held closed, being by their nature imperfectly sealed at ultra-high-pressures. It would then be necessary to provide actuators employing valves, needle valves or ball valves because these devices are inherently fluid-tight, although they generate high maneuvering forces.

SUMMARY OF THE INVENTION

It would be very useful to have reversible pressure converters, for example for storing a fluid at a high pressure in a pressure accumulator from a medium-pressure or low-pressure motorized hydraulic pump, afterwards to return said fluid to said pump/motor at a low pressure from said fluid stored at a high pressure in said accumulator.

This particular feature would notably make it possible to produce motor vehicles employing a hydraulic hybrid transmission provided with a system for storing and returning oil under pressure with a high energy capacity and a small overall size, at the same time as ensuring compatibility between the high pressure at which said oil is stored and the low pressure at which the hydraulic pump/motor used functions, or again by avoiding having said pump/motor function at a high pressure when it stores and returns said oil under pressure at a low pressure.

Thus in accordance with this principle a low-pressure pump/motor could be coupled to an ultra-high-pressure accumulator offering a high energy density per unit volume and behaving—as seen from said pump/motor—like a low-pressure accumulator. This principle would solve the crucial problem of overall size linked to storage of energy on board motor vehicles equipped with a hydraulic hybrid transmission such as that used on the prototype Hybrid Air vehicle developed by PSA Peugeot-Citroën.

Thus an ultra-high-pressure accumulator coupled to a reversible pressure converter would for example offer the two different pressures for storing and returning energy. If this principle were applied to a hydraulic hybrid transmission, the high pressure would be usable by connecting the pump/motor of said transmission directly to said ultra-high-pressure accumulator while the low-pressure would be usable by connecting said pump/motor to said accumulator via said converter.

This would notably make it possible to optimize the efficiency of said pump/motor, the pump/motor being connected to the high pressure only when used at high powers and remaining connected to the low pressure when used at low powers.

This principle would advantageously be combined, for example, with the pump/motor described in the applicant's U.S. Pat. No. 1,354,562 of 22 May 2013, said pump/motor being compatible with ultra-high-pressures of the order of two thousand bar. Subject at least to the technical configuration described in said patent, this high operational pressure would enable said pump/motor to deliver excellent efficiency, at least when said pump/motor is used at not less than half cubic capacity. Below half cubic capacity, at high pressures, the efficiency of said pump/motor is inevitably degraded because of an increasing fraction of the unrecoverable fraction of the work done to compress the oil and high friction losses relative to the useful work transmitted. Therefore, at low powers, utilizing—on the pump/motor side—a lower pressure to store and return energy would notably improve the overall efficiency of a hydraulic hybrid transmission based on said pump/motor.

In addition, such a reversible pressure converter would find numerous potential applications in industry and the home.

It is therefore to avoid the functional limitations of pressure amplifiers and notably to improve efficiency and reduce the overall size of hydraulic hybrid transmissions that the reversible hydraulic pressure converter in accordance with the invention employing tubular valves offers, depending on the embodiment adopted:

- perfect reversibility, said converter being usable interchangeably as a pressure amplifier or as a pressure reducer and switching at any time from the pressure amplifier function to the pressure reducer function and vice-versa;
- high efficiency, whether said converter is used as a pressure amplifier or as a pressure reducer;
- very simple construction;
- moderate unit cost;
- good controllability and regular flow rate;
- particularly high ruggedness and durability;
- compatibility with ultra-high-pressures, up to two thousand bar and above.

The other features of the present invention are described in the description and in the subsidiary claims depending directly or indirectly on the main claim.

The reversible hydraulic pressure converter in accordance with the invention employing tubular valves includes:

- a medium-pressure stage consisting of a medium-pressure cylinder each of the two ends of which is closed by a medium-pressure head and in which can move in translation in a fluid-tight manner on a double-acting medium-pressure piston that has a pressure face facing each medium-pressure head while said cylinder, said heads and said pressure faces form two medium-pressure chambers axially positioned on respective opposite sides of the double-acting medium-pressure piston;

at least one high-pressure stage consisting of a piston connecting rod for each pressure face, said rod having a first end fastened to the double-acting medium-pressure piston and a second end fastened to a high-pressure piston, said rod passing in a fluid-tight manner through the medium-pressure head that is located on its side so as to extend into a high-pressure cylinder the diameter of which is smaller than that of the medium-pressure cylinder, while the high-pressure piston can move in translation in a fluid-tight manner in the high-pressure cylinder, the high-pressure cylinder being closed by a high-pressure head so as to constitute with said high-pressure piston a high-pressure chamber;

at least one tubular valve for each medium-pressure chamber adapted to place the medium-pressure chamber in communication with a medium-pressure inlet-/outlet circuit, said valve cooperating with an independent valve actuator;

at least one tubular valve for each high-pressure chamber adapted to place the high-pressure chamber in communication with a high-pressure inlet-outlet circuit, said valve being adapted to be actuated to open it or to close it by an independent valve actuator;

at least one piston position sensor that can transmit to a control computer of the converter the position of the double-acting medium-pressure piston or the position of any of the high-pressure pistons.

The reversible hydraulic pressure converter in accordance with the present invention employing tubular valves includes a tubular valve that includes at least one rectilinear tube hollowed out in the axial direction to form a balancing passage, said tube being accommodated with a small clearance in a tube cylinder with which it constitutes a seal, and said tube being movable in longitudinal translation in said cylinder, the cylinder being mounted on or disposed in a valve casing inside which is provided an annular internal chamber into which discharges an annular chamber inlet-outlet orifice that communicates with an annular chamber inlet-outlet passage, said cylinder discharging into said chamber, the chamber including a closure seat opposite and coaxial with said cylinder, while the rectilinear tube has on the one hand a first end located in the annular internal chamber and terminated by a contact flange that can come into annular contact with the closure seat externally of the balancing passage so as to constitute a seal with said seat and on the other hand a second end that discharges into a balancing chamber and is mechanically connected to the valve actuator, the balancing passage establishing communication between the closure seat and the balancing chamber.

The reversible hydraulic pressure converter in accordance with the present invention employing tubular valves includes a balancing passage that communicates with a rectilinear tube inlet-outlet orifice that communicates with a rectilinear tube inlet-outlet passage that is at the center of the closure seat and passes through the closure seat axially, said orifice being located inside the annular contact that the contact flange makes with the closure seat.

The reversible hydraulic pressure converter in accordance with the present invention employing tubular valves includes a balancing passage that communicates with a rectilinear tube inlet-outlet orifice that discharges in the balancing chamber.

The reversible hydraulic pressure converter in accordance with the present invention employing tubular valves includes a rectilinear tube that includes at least one radial inlet-outlet passage disposed radially in said tube and the first end of which discharges into the balancing passage while its second end discharges into the balancing chamber.

The reversible hydraulic pressure converter in accordance with the present invention employing tubular valves includes sealing means that are inserted between the rectilinear tube and the tube cylinder.

The reversible hydraulic pressure converter in accordance with the present invention employing tubular valves includes a closure spring that cooperates with the rectilinear tube to hold the contact flange in contact with the closure surface.

The reversible hydraulic pressure converter in accordance with the present invention employing tubular valves includes a closure spring that cooperates with the rectilinear tube to hold the contact flange at a certain distance from the closure surface.

The reversible hydraulic pressure converter in accordance with the present invention employing tubular valves includes a valve actuator that includes a coil of conductive wire that attracts a magnetic core or armature when an electrical current passes through said coil, said core or armature being fastened directly or indirectly to the second end of the rectilinear tube.

The reversible hydraulic pressure converter in accordance with the present invention employing tubular valves includes a coil of conductive wire is that is accommodated inside the balancing chamber.

The reversible hydraulic pressure converter in accordance with the present invention employing tubular valves includes a coil of conductive wire that is accommodated outside the balancing chamber, the magnetic field generated by said coil when an electrical current passes through it passing through the external wall of said chamber so as to exert a force on the magnetic core or armature.

The reversible hydraulic pressure converter in accordance with the present invention employing tubular valves includes a contact flange that is a truncated sphere and has a line of contact with the closure seat similar to that which a ball bearing on a seat forms.

The reversible hydraulic pressure converter in accordance with the present invention employing tubular valves includes a closure seat on a floating plate free to align radially with the contact flange when the contact flange comes into contact with the closure seat while said plate bears in a fluid-tight manner on a plate seat in the valve casing.

The reversible hydraulic pressure converter in accordance with the present invention employing tubular valves includes a floating plate that constitutes with the valve casing a check valve that can open when the pressure in the rectilinear tube inlet-outlet passage is greater than the pressure in the annular internal chamber, said plate otherwise bearing in a fluid-tight manner on the plate seat.

In the reversible hydraulic pressure converter in accordance with the present invention employing tubular valves the section of the annular contact formed between the contact flange and the closure seat is slightly greater than the section of the tube cylinder.

The reversible hydraulic pressure converter in accordance with the present invention employing tubular valves includes a valve check valve that is mounted in parallel with the tubular valve and on the same circuit whatever the circuit is or in series with said valve and before or after the valve.

The reversible hydraulic pressure converter in accordance with the present invention employing tubular valves includes a medium-pressure inlet-outlet circuit and/or a high-pressure inlet-outlet circuit that can connect the tubular valve with which cooperates to a pressure accumulator.

The reversible hydraulic pressure converter in accordance with the present invention employing tubular valves includes a medium-pressure inlet-outlet circuit and/or a high-pressure inlet-outlet circuit that can connect the tubular valve with which it cooperates to a hydraulic pump/motor.

The reversible hydraulic pressure converter in accordance with the present invention employing tubular valves includes a vent orifice that passes axially through the closure seat.

The reversible hydraulic pressure converter in accordance with the present invention employing tubular valves includes a low-pressure head and/or a high-pressure cylinder and/or a high-pressure head and/or a valve casing that are made in one piece.

BRIEF DESCRIPTION OF THE DRAWINGS

The following description with reference to the appended drawings, which are provided by way of nonlimiting example, will better explain the invention, its features and the advantages that it is able to procure.

DETAILED DESCRIPTION OF THE INVENTION

The reversible hydraulic pressure converter 1 employing tubular valves is shown in FIGS. 1 to 8.

Figure 1:
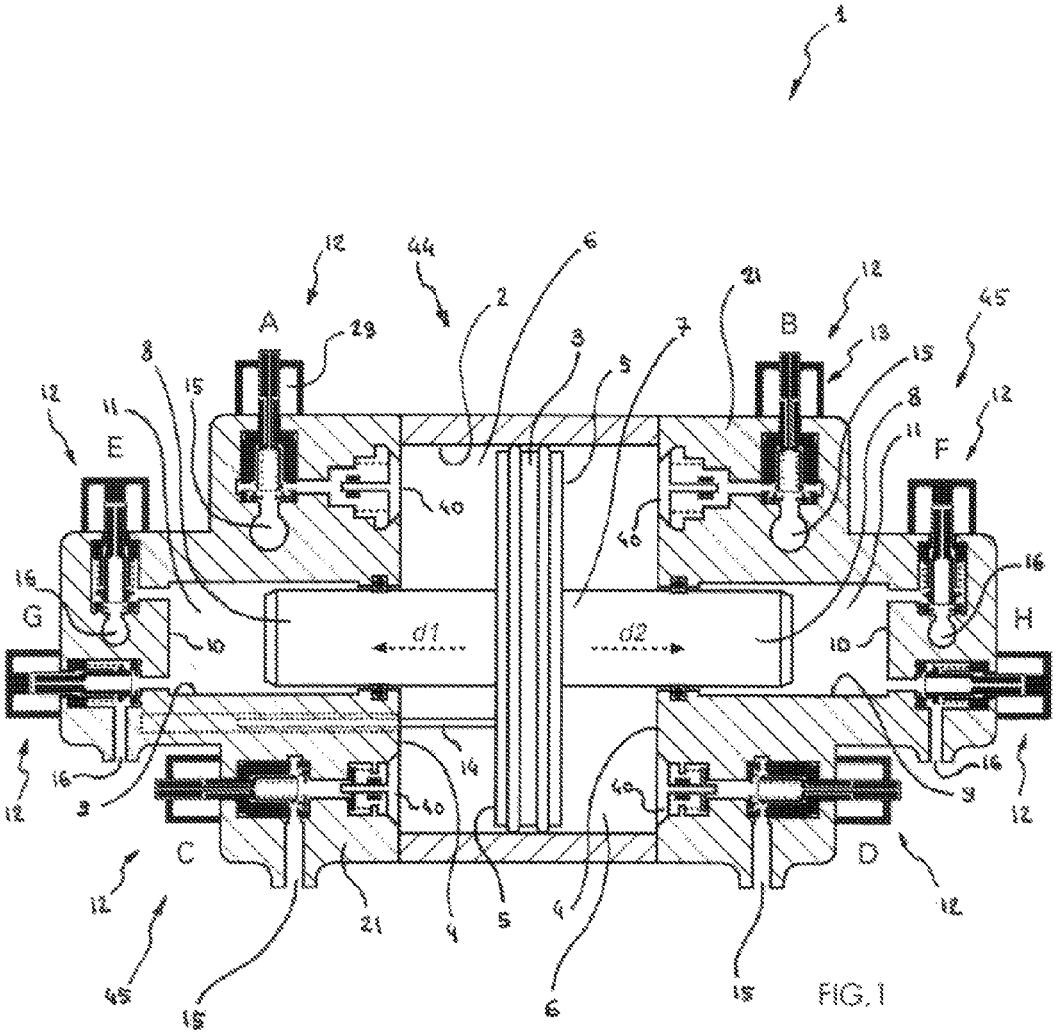
FIG. 1 shows in diagrammatic section one embodiment of the reversible hydraulic pressure converter in accordance with the present invention employing tubular valves that includes a medium-pressure stage including tubular valves including a rectilinear tube the contact flange of which is held at a certain distance from the closure surface by the closure spring while the tubular valves of the high-pressure stage include a rectilinear tube the contact flange of which is held in contact with the closure surface by the closure spring, said flange cooperating with a floating plate to constitute with the valve body a check valve.

It is seen—particularly in FIG. 1—that the reversible hydraulic pressure converter 1 in accordance with the invention employing tubular valves includes a medium-pressure stage 44 consisting of a medium-pressure cylinder 2 each of the two ends of which is closed by a medium-pressure head 4 and in which can move in translation in a fluid-tight manner a double-acting medium-pressure piston 3 that has a pressure face 5 facing each medium-pressure head 4 while said cylinder 2, said heads 4 and said pressure faces 5 form two medium-pressure chambers 4 positioned axially on respective opposite sides of the double-acting medium-pressure piston 3.

Note that the double-acting medium-pressure piston 3 may be provided with at least one ring or at least one seal of any type known to the person skilled in the art.

The pressure converter 1 in accordance with the invention further includes at least one high-pressure stage 45 consisting of a piston connecting rod 7 on each pressure face 5, said rod 7 having a first end fastened to the double-acting medium-pressure piston 3 and a second end fastened to a high-pressure piston 8, said rod 7 passing in a fluid-tight manner through the medium-pressure head 4 that is located on its side so as to extend into a high-pressure cylinder 9 the diameter of which is smaller than that of the medium-pressure cylinder 2, while the high-pressure piston 8 can move in translation in a fluid-tight manner in the high-pressure cylinder 9, which is closed by a high-pressure head 10 so as to constitute with said high-pressure piston 8 a high-pressure chamber 11.

In accordance with one particular embodiment of the pressure converter 1 in accordance with the invention, the high-pressure piston 8 may include at least one seal or at least one ring or be of the plunger type to cooperate with at least one seal or at least one ring fastened to the high-pressure cylinder 9 to form as strong as possible a seal.

Figure 2:
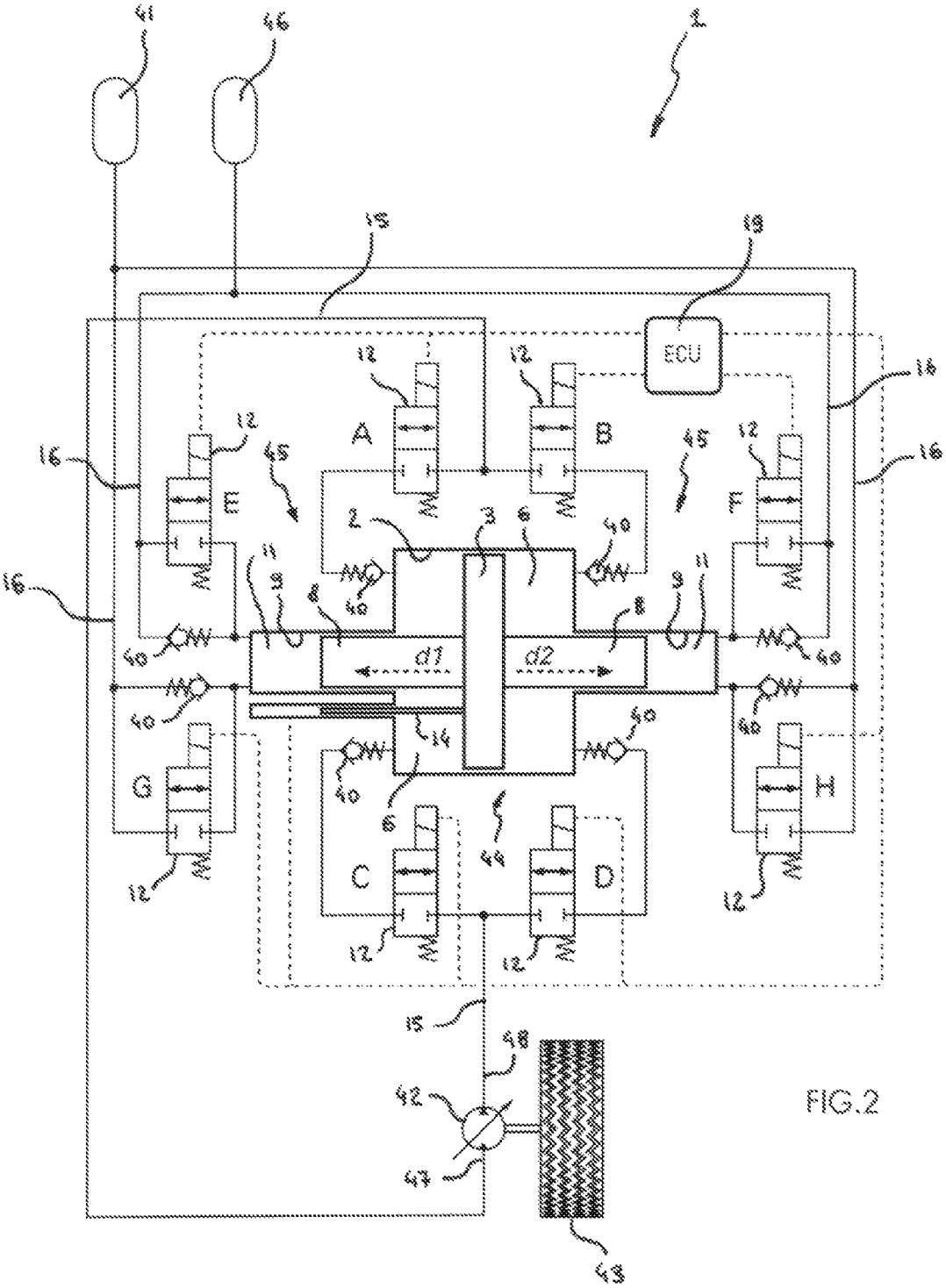
FIG. 2 is the theoretical circuit diagram of the reversible hydraulic pressure converter in accordance with the present invention employing tubular valves as it may be used in the context of a hydraulic hybrid transmission, the medium-pressure stage being inserted between a pump inlet and a pump outlet of a motorized hydraulic pump connected to a wheel while the high-pressure stage is inserted between a low-pressure reservoir and the pressure accumulator.

It is seen in FIGS. 1 and 2 that the pressure converter 1 in accordance with the invention includes at least one tubular valve 12 for each medium-pressure chamber 5 for connecting the medium-pressure chamber 5 to a medium-pressure inlet-outlet circuit 15, said valve 12 cooperating with an independent valve actuator 13.

FIGS. 1 and 2 also show that the reversible hydraulic pressure converter 1 in accordance with the invention employing tubular valves also includes at least one tubular valve 12 for each high-pressure chamber 11 for connecting the high-pressure chamber 11 to a high-pressure inlet-outlet circuit 16, which valve 12 can be actuated to open or close it by an independent valve actuator 13.

Note further that the tubular valves 12, regardless of the chambers 5, 11 into which they discharge, may be of the slide valve, poppet valve, needle valve, butterfly valve, ball valve, tube-lift valve type or of any type known to the person skilled in the art, while the valve actuator 13 may be electrical, pneumatic or hydraulic and can open or close the tubular valve 12 to which it is connected or, where appropriate, hold the tubular valve 12 open or closed.

FIGS. 1 and 2 also show that the reversible hydraulic pressure converter 1 in accordance with the invention employing tubular valves also includes at least one tubular valve 12 for each high-pressure chamber 11 for connecting the latter to a high-pressure inlet-outlet circuit 16, which valve 12 can be actuated to open or close it by an independent valve actuator 13.

Note further that the tubular valves 12, regardless of the chambers 5, 11 into which they discharge, may be of the slide valve, poppet valve, needle valve, butterfly valve, ball valve, tube-lift valve type or of any type known to the person skilled in the art, while the valve actuator 13 may be electrical, pneumatic or hydraulic and can open or close the tubular valve 12 to which it is connected or, where appropriate, hold the latter open or closed.

As FIGS. 1 and 2 show, the pressure converter 1 in accordance with the invention also includes at least one piston position sensor 14 that can send to a computer controlling the converter 19 the position of the double-acting medium-pressure piston 3 or the position of any of the high-pressure pistons 8. Note that the piston position sensor 14 may be of the contact, contactless, optical, resistive, inductive, capacitive, Hall effect type or any type known to the person skilled in the art.

It is seen in FIG. 1 and in FIGS. 3 to 8 that the tubular valve 12 may include at least one rectilinear tube 20 that is hollowed out in the axial direction to form a balancing passage 32, said tube 20 being accommodated with a small clearance in a tube cylinder 24 with which it constitutes a seal, and said tube 20 is able to move in longitudinal translation in said cylinder 24, the cylinder 24 being mounted on or disposed in a valve body 21 in which there is an annular internal chamber 22 into which discharges an annular chamber inlet-outlet orifice 23 that communicates with an annular chamber inlet-outlet passage 37, said cylinder 24 discharging into said chamber 22 which includes a closure seat 27 opposite and coaxial with said cylinder 24, while the rectilinear tube 20 has on the one hand a first end 25 located in the annular internal chamber 22 and terminated by a contact flange 34 that can come into annular contact with the closure seat 27 externally of the balancing passage 32 so as to constitute a seal with said seat 27 and on the other hand a second end 26 that discharges into a balancing chamber 31 and is mechanically connected to the valve actuator 13, the balancing passage 32 establishing communication between the closure seat 27 and the balancing chamber 31.

In accordance with this configuration, as FIGS. 3 to 7 show, the balancing passage 32 can communicate with a rectilinear tube inlet-outlet orifice 35 that communicates with a rectilinear tube inlet-outlet passage 38 at the center of the closure seat 27 and passes through the closure seat 27 in the axial direction, said orifice 35 being located inside the annular contact that can be established between the contact flange 34 and the closure seat 27.

In this case, a fluid can move between the annular internal chamber 22 and the rectilinear tube inlet-outlet orifice 35 without passing through the balancing passage 32 when the contact flange 34 is held away from the closure seat 27 by the valve actuator 13, said fluid being unable to effect any such movement when said flange 34 is left in annular contact with the closure seat 27 by the valve actuator 13, said contact constituting a seal between said flange 34 and said seat 27.

Figure 8:
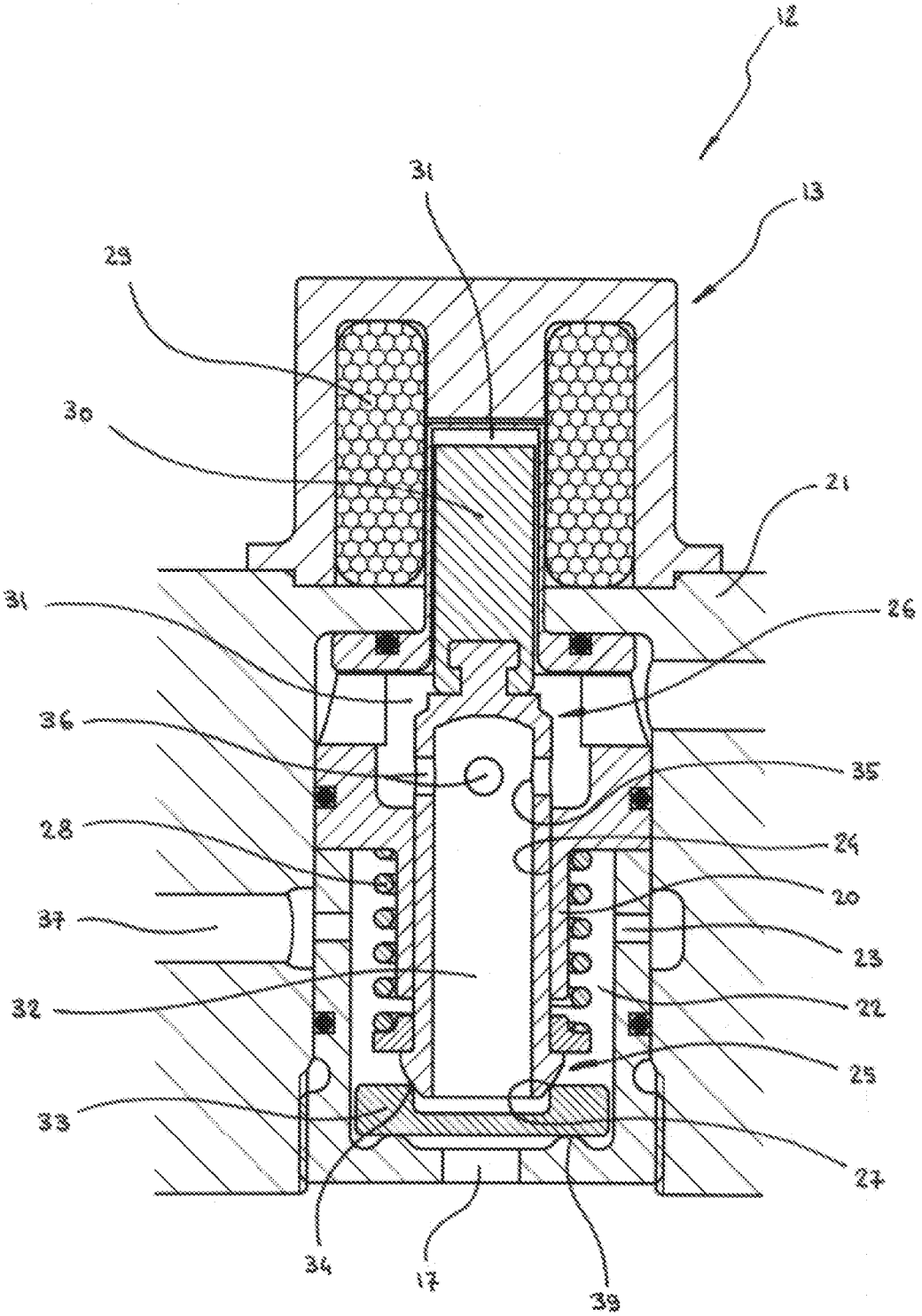
FIG. 8 is a diagrammatic section of a variant of the tubular valve of the reversible hydraulic pressure converter in accordance with the invention employing tubular valves, said valve featuring a rectilinear tube that includes radial inlet-outlet passages whereas the contact flange of said tube is held in contact with the closure surface by the closure spring, while the valve actuator of said valve consists of a coil of conductive wire that can attract a magnetic core or armature

In accordance with the variant shown in FIG. 8, the balancing passage 32 may communicate with a rectilinear tube inlet-outlet orifice 35 that discharges into the balancing chamber 31. In accordance with this configuration, a fluid can move between the annular internal chamber 22 and the rectilinear tube inlet-outlet orifice 35 via the balancing passage 32 when the contact flange 34 is held away from the closure seat 27 by the valve actuator 13, said fluid being unable to effect any such movement when said flange 34 is left in annular contact with the closure seat 27 by the valve actuator 13, said contact constituting a seal between said flange 34 and said sleeve 27.

The variant shown in FIG. 8 also shows that the rectilinear tube 20 may include at least one radial inlet-outlet passage 36 disposed radially in said tube 20 and the first end of which discharges into the balancing passage 32 while its second end discharges into the balancing chamber 31.

In the reversible hydraulic pressure converter 1 in accordance with the invention employing tubular valves, sealing means may be inserted between the rectilinear tube 20 and the tube cylinder 24 and may consist of at least one annular seal and/or at least one ring.

Figure 3:
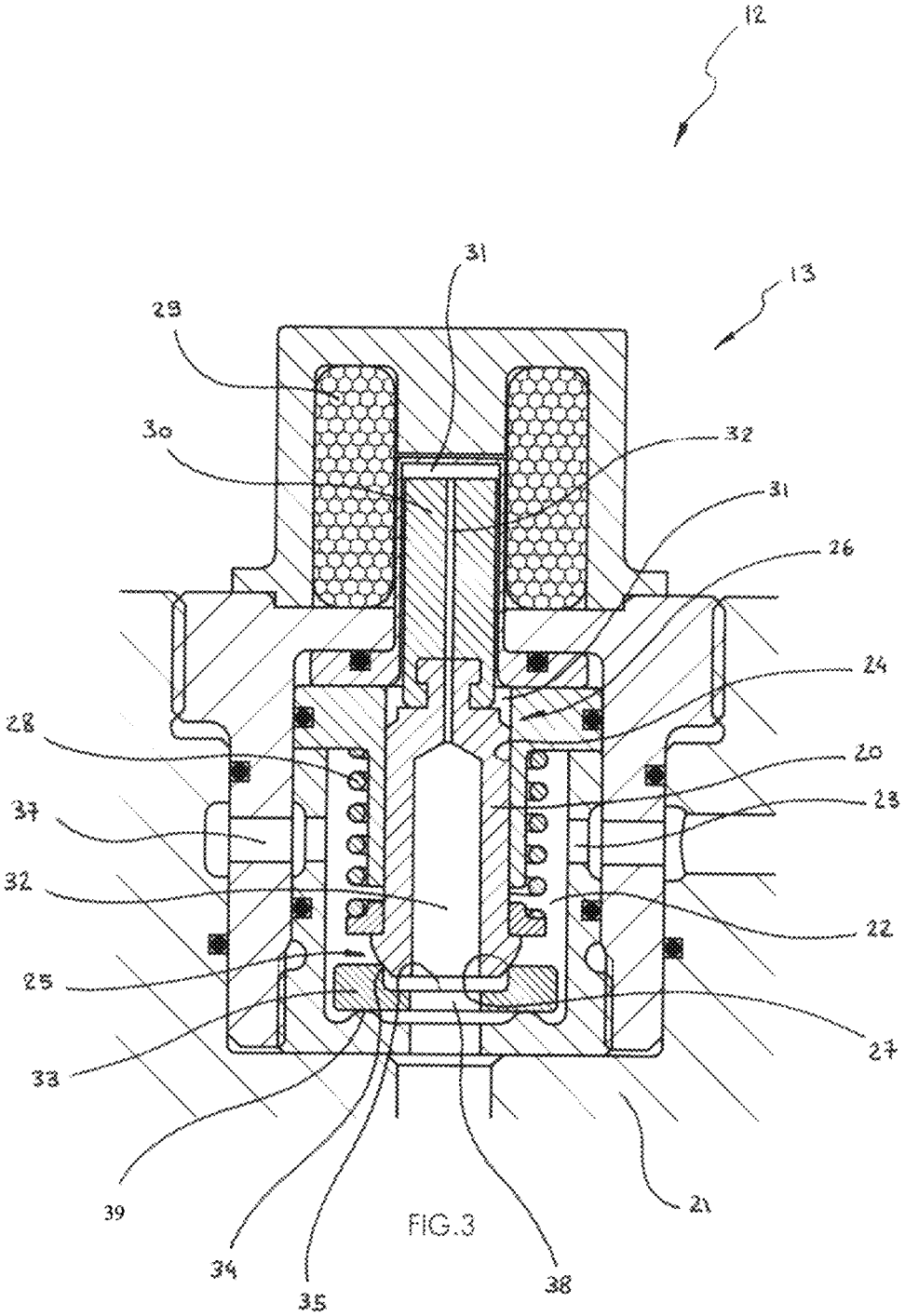
FIGS. 3 to 5 are diagrammatic sections illustrating the operation of a variant of the tubular valve of the reversible hydraulic pressure converter in accordance with the present invention employing tubular valves, said valve including a rectilinear tube the contact flange of which is held in contact with the closure surface by the closure springs, said valve also including a floating plate that constitutes with the valve body a check valve, and having a valve actuator consisting of a coil of conductive wire that is able to attract a magnetic core or armature
Figure 4:
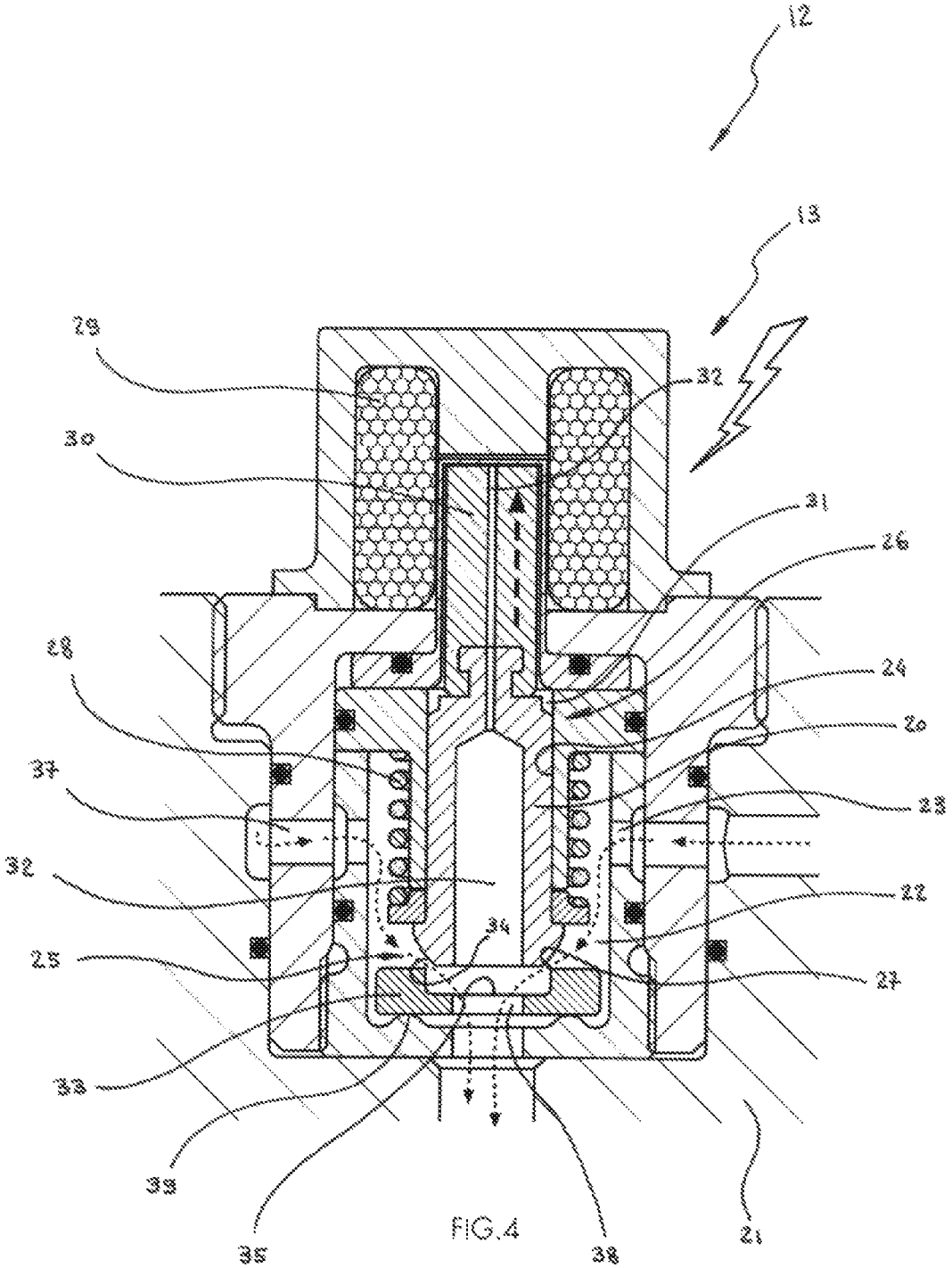
Figure 5:
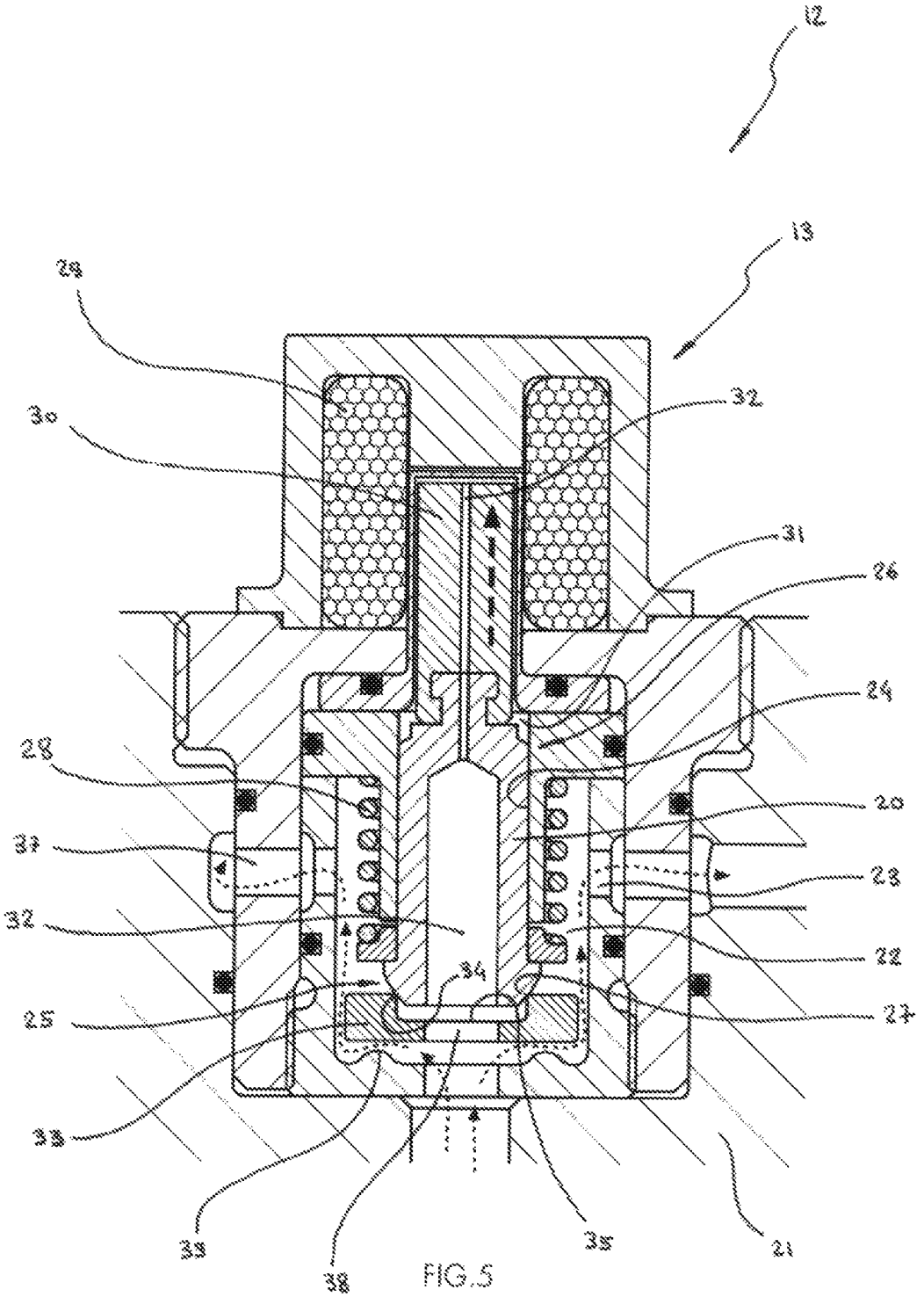

In FIGS. 3 to 5 and in FIG. 8, note that a closure spring 28 may cooperate with the rectilinear tube 20 to hold the contact flange 34 in contact with the closure surface 27 while the valve actuator 13 is sufficiently powerful to apply to the second end 26 a force antagonistic to that produced by said spring 28 such that said actuator 13 can move the contact flange 34 away from the closure surface 27 or hold it away from it.

Figure 6:
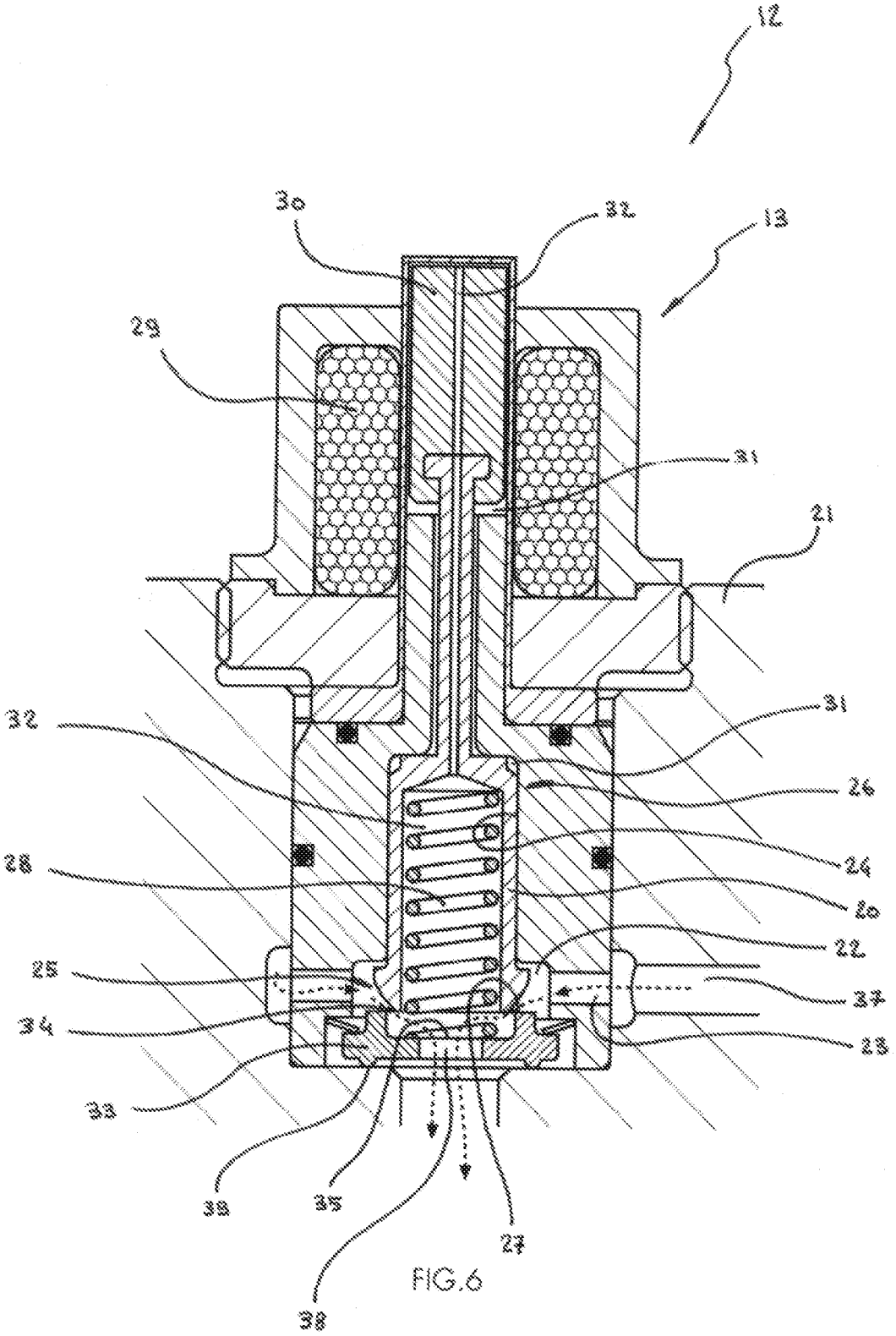
FIGS. 6 and 7 are diagrammatic sections illustrating the operation of a variant of the tubular valve of the reversible hydraulic pressure converter in accordance with the present invention employing tubular valves, said valve including a rectilinear tube the contact flange is held at a certain distance from the closure surface by the closure spring, said valve also having a valve actuator that consists of a coil of conductive wire that can attract a magnetic core or armature
Figure 7:
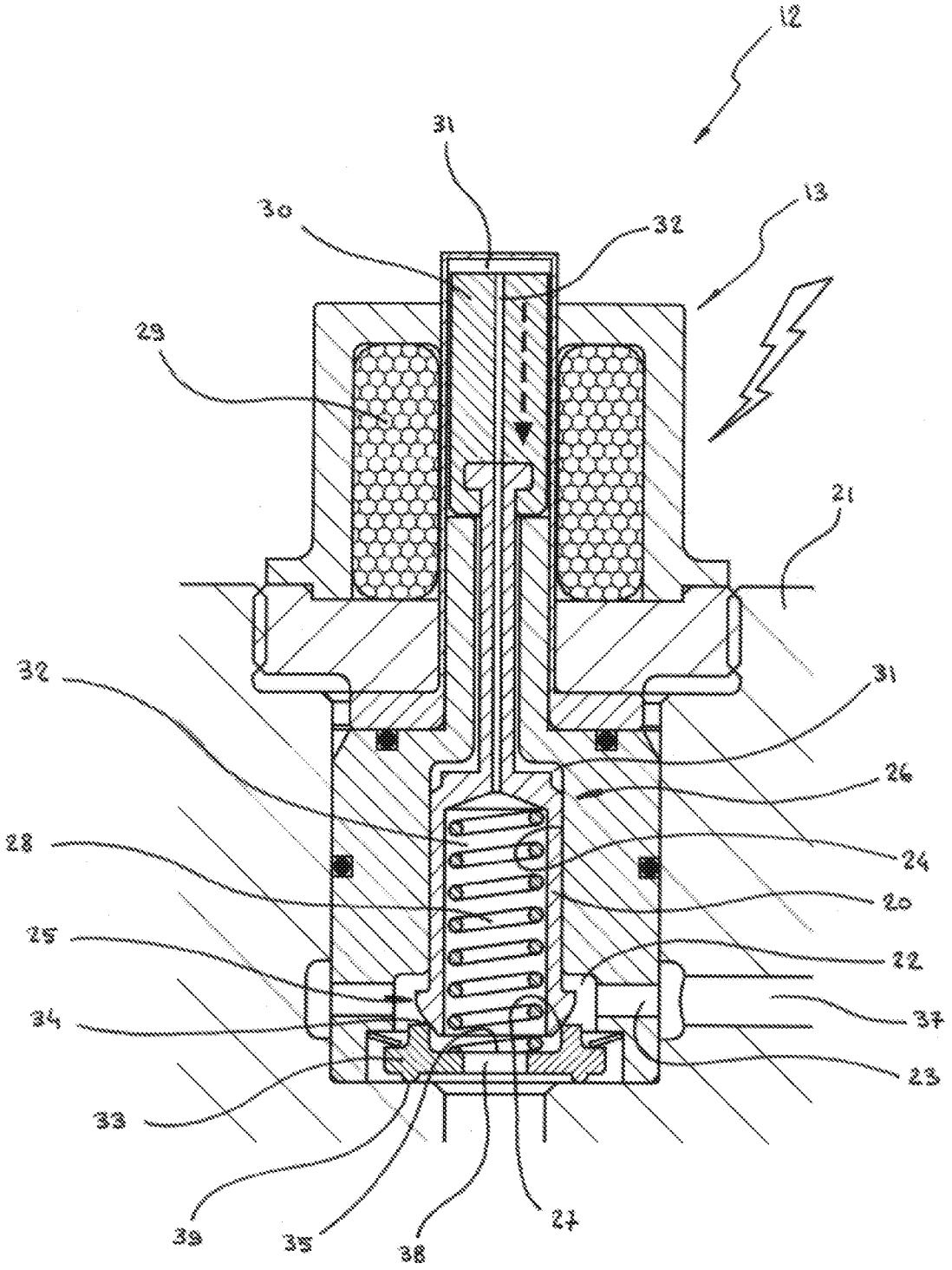

Conversely, in accordance with the variant shown in FIGS. 6 and 7, a closure spring 28 may cooperate with the rectilinear tube 20 to hold the contact flange 34 at a certain distance from the closure surface 27 while the valve actuator 13 is sufficiently powerful to apply to the second end 26 a force antagonistic to that produced by said spring 28 such that said actuator 13 can force the contact flange 34 to come into contact with the closure surface 27 and where applicable can hold said flange 34 in contact with said surface 27.

Note that regardless of the configuration for moving the contact flange 34 toward or away from the closure surface 27, the closure spring 28 may be a coil spring, a leaf spring, one or more spring washers, operate in traction, in compression, in torsion, or generally speaking be of any type known to the person skilled in the art.

As shown in FIG. 1 and in FIGS. 3 to 8, in the reversible hydraulic pressure converter 1 in accordance with the invention employing tubular valves the valve actuator 13 may include a coil 29 of conductive wire that attracts a magnetic core or armature 30 when an electrical current is passed through said coil 29, said core or armature 30 being fastened directly or indirectly to the second end 26 of the rectilinear tube 20.

Note that the coil 29 of conductive wire and the magnetic core or armature 30 may also be replaced by a stack of piezoelectric layers, by a staggered hydraulic actuator known in itself, by a pneumatic actuator or lung or by any other arrangement enabling a force to be exerted on the second end 26 of the rectilinear tube 20.

Note also that the coil 29 of conductive wire may be accommodated inside the balancing chamber 31 or outside the balancing chamber 31, as FIGS. 3 to 8 more particularly show. In this case, the magnetic field generated by said coil 29 when an electrical current passes through it passes through the external wall of said chamber 31 so as to exert a force on the magnetic core or armature 30, said external wall being preferably made from an amagnetic material in this case.

Note that—particularly in FIGS. 3 to 8—the contact flange 34 may be a truncated sphere and have a line of contact with the closure seat 27 similar to that which a ball bearing on a seat forms.

The same FIGS. 3 to 8 also show that the closure seat 27 may be on a floating plate 33 free to align radially with the contact flange 34 when the contact flange 34 comes into contact with the closure seat 27 while said plate 33 bears in a fluid-tight manner on a plate seat 39 in the valve casing 21 and said plate 33 can be held pressed onto the valve body 21 by a spring that may be a corrugated washer, for example.

In accordance with a variant embodiment of the reversible hydraulic pressure converter 1 in accordance with the invention employing tubular valves shown particularly in FIGS. 3 to 5, the floating plate 33 may constitute with the valve casing 21 a check valve that can open when the pressure in the rectilinear tube inlet-outlet passage 38 is greater than the pressure in the annular internal chamber 22, said plate 33 otherwise bearing in a fluid-tight manner on the plate seat 39.

In this case, the floating plate 33 may be held in contact with the plate seat 39 by the closure spring 28 via the contact flange 34 which—thanks to said spring 28—exerts a force on the closure surface 27 on said plate 33.

Note that the section of the annular contact formed between the contact flange 34 and the closure seat 27 may be slightly greater than the section of the tube cylinder 24 so that the pressure in the annular internal chamber 22 tends to press the contact flange 34 against the closure seat 27 when said pressure is greater than that in the balancing passage 32.

By way of a variant shown diagrammatically in FIG. 2, a valve check valve 40 may be mounted in parallel with the tubular valve 12 and on the same circuit 15, 16 regardless of the circuit 15, 16, or in series with said valve 12 and before or after the valve 12, said check valve 40 being for example a ball or a poppet valve guided by a stem accommodated in a guide, said ball valve or said poppet valve being held in contact with a seat by a spring.

Note that, as shown in FIG. 2, the medium-pressure inlet-outlet circuit 15 and/or the high-pressure inlet-outlet circuit 16 may connect the tubular valve 12 with which it cooperates to a pressure accumulator 41 which may be of the membrane, piston, gas or spring type or generally speaking of any type known to the person skilled in the art.

Furthermore, the medium-pressure inlet-outlet circuit 15 and/or the high-pressure inlet-outlet circuit 16 may also connect the tubular valve 12 with which it cooperates to a hydraulic pump/motor 42 that may employ radial or axial pistons, vanes, screws, internal or external gears, with a variable or non-variable cubic capacity, or be of any type known in itself. This configuration is shown in FIG. 2.

Note in FIG. 8 that the closure seat 27 may have a vent orifice 17 passing through it axially so that the pressure in the annular internal chamber 22 and/or in the balancing chamber 31 presses the floating plate 33 onto the valve casing 21. Note that in accordance with this configuration, when there is no pressure in said chambers 22, 31, the closure seat 27 remains free to take up a position centered relative to the contact flange 34, this being assisted by the force produced by the closure spring 28.

Finally, in accordance with a variant embodiment of the reversible hydraulic pressure converter 1 in accordance with the invention employing tubular valves, the low-pressure head 4 and/or the high-pressure cylinder 9 and/or the high-pressure head 10 and/or the valve casing 21 may be made in one piece.

Operation of the Invention

The operation of the reversible hydraulic pressure converter 1 in accordance with the invention employing tubular valves is obvious from the foregoing description and with reference to FIGS. 1 to 8.

To illustrate the operation of said converter 1, the choice has been made to employ it to accumulate energy in a pressure accumulator 41 in the form of a volume of nitrogen compressed by a volume of oil.

As shown in FIG. 2, the choice has also been made to insert the medium-pressure stage 44 between a pump inlet 47 and a pump outlet 48 of a variable cubic capacity hydraulic pump/motor 42 the maximum operating pressure of which is three hundred bar, while the high-pressure stage 45 is inserted between a low-pressure reservoir 46 that stores oil at a low pressure and a pressure accumulator 41 the pressure of which is—in this nonlimiting example—between nine hundred bar when said accumulator 41 is empty and one thousand eight hundred bar when said accumulator 41 is full.

Thus the cubic capacity of the medium-pressure stage 44 is six times greater than that of the high-pressure stage 45, i.e. the usable section of a double-acting medium-pressure piston 3 is six times greater than that of the high-pressure pistons 8.

Configured in this way, the hydraulic pressure converter 1 can use a flow of oil supplied at a pressure of three hundred bar by the hydraulic pump/motor 42 at the level of its pump outlet 48 to store energy in the form of compressed nitrogen at a six times greater pressure of one thousand eight hundred bar in the pressure accumulator 41. Said converter 1 can then subsequently convert said energy back into a flow of oil at a pressure of three hundred bar that is available at the pump inlet 47 to drive the hydraulic pump/motor 42. Note that in accordance with this configuration the flow of oil established at the pump inlet 47 is approximately six times less than that leaving the pressure accumulator 41.

Note that in accordance with the example of use of the pressure converter 1 in accordance with the invention taken here to illustrate its operation, the hydraulic pump/motor 42 is connected to at least one wheel 43 of a motor vehicle, not shown, in the context of a hydraulic hybrid transmission, not shown, which may include another hydraulic pump/motor, not shown.

Thanks to the hydraulic pressure converter 1 in accordance with the invention, despite the fact that the maximum operating pressure of the hydraulic pump/motor 42 is only three hundred bar, the hydraulic pump/motor 42 can brake the motor vehicle and store kinetic energy in the form of compressed nitrogen at between nine hundred and one thousand eight hundred bar in the pressure accumulator 41.

Thus the hydraulic pump/motor 42 produces a flow of oil the pressure of which is only one hundred and fifty bar when the pressure accumulator 41 is empty—for example at the start of regenerative braking of the motor vehicle—and only three hundred bar when said accumulator 41 is full, for example at the end of braking of said vehicle. The corresponding pressures in the pressure accumulator 41 between the start and end of regenerative braking of said vehicle are therefore between nine hundred and one thousand eight hundred bar, respectively.

Conversely, in the phase of re-acceleration of the motor vehicle, the hydraulic pressure converter 1 in accordance with the invention converts a flow of oil at a pressure of one thousand eight hundred bar leaving the pressure accumulator 41 into a forced flow of oil six times greater but at a pressure reduced to three hundred bar at the pump inlet 47 of the hydraulic pump/motor 42.

Thus the volume for storing the energy recovered on braking the motor vehicle is divided by approximately six by the hydraulic pressure converter 1 in accordance with the invention. In fact, without said converter 1, it would be necessary—for the same stored energy—to provide a pressure accumulator 41 of six times the volume operating on average at a pressure six times lower.

In accordance with the embodiment of the pressure converter 1 in accordance with the invention shown in FIG. 1, the pressure converter 1 is provided with eight tubular valves 12 each including a rectilinear tube 20. It is assumed here that the same configuration of use is retained for said converter 1 in the context illustrated by FIG. 2.

As FIG. 2 shows, to accommodate the particular functioning of the hydraulic pump/motor 42, the tubular valves 12 in the medium-pressure inlet-outlet circuits 15 are connected in series with a valve check valve 40 taking the form—as FIG. 1 shows—of a poppet valve the stem of which is guided in a guide and that is held in contact with a seat by a spring.

As can be seen in FIG. 1, the valve check valves 40 are placed between the medium-pressure cylinder 2 and the tubular valve 12 with which they cooperate. This configuration makes it possible to leave the least possible dead volume between the double-acting medium-pressure piston 3 and one or other of the low-pressure heads 4 when said piston 3 is closest to said heads 4.

Note also in FIGS. 1 and 2 the piston position sensor 14 which advises the computer controlling the converter 19 of the position of the double-acting medium-pressure piston 3, said sensor 14 simultaneously informing said computer 19 of the position of the high-pressure pistons 8 since the high-pressure pistons 8 are fastened to the double-acting medium-pressure piston 3.

Note that the tubular valves 12 in the medium-pressure inlet-outlet circuits 15 may advantageously be so-called "normally open" valves like the one shown diagrammatically in FIGS. 6 and 7, i.e. if no electrical current is applied to the terminals of their coil 29 of conductive wire, their contact flange 34 continues to be held at a certain distance from the closure surface 27 by the closure spring 28.

Note in FIG. 1 that the tubular valves 12 placed in the high-pressure inlet-outlet circuits 16 may advantageously be so-called "normally closed" valves, i.e. if no electrical current is applied to the terminals of their coil 29 of conductive wire, their contact flange 34 remains held in contact with the closure surface 27 by the closure spring 28. This configuration of the tubular valve 12 is shown in more detail in FIGS. 3, 4 and 5.

Note also in FIGS. 1, 3, 4 and 5 that the tubular valves 12 placed in the high-pressure inlet-outlet circuits 16 advantageously include a floating plate 33 that with the valve casing 21 constitutes a check valve, said plate 33 being able to bear in a fluid-tight manner on a plate seat 39 in the valve casing 21.

Note in FIG. 1 the orientation and the particular connection of said valves 12 that establishes communication between their annular internal chamber 22 and their balancing chamber 31 with the correct members found in FIG. 2, so that the check valves that the floating plates 33 constitute with their valve casing 21 can operate as the operation of the pressure converter 1 in accordance with the invention requires.

This having been explained, note that when the pressure converter 1 in accordance with the invention is used as a pressure amplifier, the medium-pressure stage 44 operates in "motor" mode while the high-pressure stage 45 operates in "pump" mode and conversely, when said converter 1 is used as a pressure reducer, the medium-pressure stage 44 operates in "pump" mode while the high-pressure stage 45 operates in "motor" mode.

Note that when the medium-pressure stage 44 operates in "motor" mode, only the valve actuators 13 of the tubular valves 12 of said stage 44 are loaded to close said valves 12 which as previously indicated are "normally open", the valve actuators 13 of the tubular valves 12 of the high-pressure stage 45 not being loaded when said stage 45 operates in "pump" mode.

Accordingly, the valve actuators 13 of the medium-pressure stage 44 oblige the hydraulic pump/motor 42 to force oil under pressure alternately into the medium-pressure chamber 6 placed—in FIGS. 1 and 2—on the left of the double-acting medium-pressure piston 3, then in that on the right of said piston 3.

The moment at which the oil expelled by the hydraulic pump/motor 42 changes destination and ceases to feed one medium-pressure chamber 6 to feed the other one is determined by the computer controlling the converter 19 as a function of the position of the double-acting medium-pressure piston 3 that the piston position sensor 14 sends it.

The operation of the converter 1 in accordance with the invention is readily understood in the light of FIGS. 1 and 2 in which, for greater clarity, the tubular valves 12 of the medium-pressure stage 44 are marked with the letters A, B, C and D while the tubular valves 12 of the high-pressure stage 45 are identified by the letters E, F, G and H.

In a similar way and for a better understanding of the operation of the converter 1 in accordance with the invention, the notation d1 and d2 appear above arrows indicating the direction of movement of the double-acting medium-pressure piston 3. Said direction is also that of the high-pressure pistons 8 since the high-pressure pistons 8 are fastened to the double-acting medium-pressure piston 3. The reference d1 therefore indicates that said double-acting medium-pressure piston 3 moves toward the left, while the reference d2 indicates that this same piston 3 moves toward the right.

When the converter 1 in accordance with the invention must transform the hydraulic pressure of up to three hundred bar encountered at the pump outlet 48 into a hydraulic pressure six times higher intended to be stored in the pressure accumulator 41, for example during braking of the motor vehicle, not shown, the computer controlling the converter 19 simultaneously closes the tubular valves 12 B and 12 C, for example, by energizing their coil 29 of conductive wire. The oil expelled at the pump outlet 48 is therefore forced to fill the right-hand medium-pressure chamber 6 via the tubular valve 12 D which is open because it is "normally open", whereas the oil contained in the left-hand medium-pressure chamber 6 can only leave via the tubular valve 12 A after passing through the valve check valve 40 that cooperates with said tubular valve 12 A, to return to the pump inlet 47. Consequently, the double-acting medium-pressure piston moves in the direction d1.

The oil in the left-hand high-pressure chamber 11 in FIGS. 1 and 2 is therefore compressed to a pressure slightly greater than one thousand eight hundred bar, then expelled from said chamber 11 to the pressure accumulator 41 via the check valve that the floating plate 33 of the tubular valve 12 G constitutes with its valve casing 21, the identical check valve of the tubular valve 12 E preventing said oil from returning to the low-pressure reservoir 46.

Simultaneously, the right-hand high-pressure chamber 11 in FIGS. 1 and 2 is decompressed so that oil is aspirated into the low-pressure reservoir 46 via the check valve that the floating plate 33 of the tubular valve 12 F constitutes with it valve casing 21, while the identical check valve of the tubular valve 12 H prevents any oil coming from the pressure accumulator 41 entering said right-hand high-pressure chamber 11.

Throughout this movement of the double acting medium-pressure piston 3 in the direction d1, the piston position sensor 14 will have continuously fed back the position of said double acting piston 3 to the computer controlling the converter 19. When the converter 19 determines that said double acting piston 3 is sufficiently close to the left-hand medium-pressure head 4, it reverses the direction of movement of said double acting piston 3 so that the double acting piston 3 afterwards moves in the direction d2. To this end, said computer ceases to supply with electrical current the coil 29 of conductive wire of the tubular valves 12 B and 12 C, the effect of which is to open them, while it energizes the coil 29 of conductive wire of the tubular valves 12 A and 12 D, the effect of which is to close the tubular valves 12 A and 12 D.

The operation of the converter 1 in accordance with the invention in the direction d2 is strictly identical, the role of the tubular valves 12 B and 12 C being transferred to the tubular valves 12 A and 12 D, while the check valve formed by the floating plate 33 of the tubular valves 12 G and 12 F closes by virtue of the effect of the pressure while that of the tubular valves 12 E and 12 H opens, for the same reasons.

When the converter 1 in accordance with the invention must convert the pressure of one thousand eight hundred bar stored in the pressure accumulator 41, for example, into a pressure six times lower to feed the pump inlet 47, for example when the motor vehicle (not shown) accelerates again, not shown, the control computer of the converter 19 simultaneously opens the tubular valves 12 H and 12 E, for example, by energizing their coil 29 of the conductive wire.

Thus the oil under pressure stored in the pressure accumulator 41 enters the right-hand high-pressure chamber 11 via the tubular valve 12 H, said oil then pushing on the right-hand high-pressure piston 8, while the left-hand high-pressure piston 11 expels the oil contained in he left-hand high-pressure chamber 11 into the low-pressure reservoir 46 via the tubular valve 12 E.

Consequently, the double-acting medium-pressure piston 3 moves in the direction d1 and compresses the oil contained in the left-hand medium-pressure chamber 6. The effect of this is on the one hand to expel said oil from said chamber 6 via the valve check valve 40 mounted in series with the tubular valve 12 A, the valve check valve 40 mounted in series with the tubular valve 12 C remaining closed because of the effect of the pressure, and, on the other hand, to feed the pump inlet 47 with oil the pressure of which may be three hundred bar, for example. Furthermore, the right-hand medium-pressure chamber 6 receives oil at a low pressure coming from the pump outlet 48 via the valve check valve 40 mounted in series with the tubular valve 12 D. As a result of this the hydraulic pump/motor 42 drives the wheel 43 of the motor vehicle, not shown, so as to accelerate the motor vehicle.

During the movement of the double-acting medium-pressure piston 3 in the direction d1, the piston position sensor 14 will also have continuously fed the position of said double-acting piston 3 back to the control computer of the converter 19. Accordingly, when the converter 19 determines that said double-acting piston 3 is sufficiently close to the left-hand medium-pressure head 4, it reverses the direction of movement of said double-acting piston 3 so that the double-acting piston 3 afterwards moves in the direction d2. To this end, said computer 19 ceases to feed electrical current to the coil 29 of conductive wire of the tubular valves 12 H and 12 E, the effect of which is to close them, while it energizes the coil 29 of conductive wire of the tubular valves 12 G and 12 F, which has the effect of opening the tubular valves.

The operation of the converter 1 in accordance with the invention in the direction d2 is strictly identical, the role of the tubular valves 12 H and 12 E being transferred to the tubular valves 12 G and 12 F, whereas the valve check valves 40 mounted in series with the tubular valves 12 D and 12 A are naturally closed by the effect of the pressure while the valve check valves 40 mounted in series with the tubular valves 12 C and 12 B open, also because of the effect of the pressure.

Note that the control computer of the converter 19 can—notably thanks to the piston position sensor 14—still exercise precise control of the oil inlets and outlets of the medium-pressure stage 44 or the high-pressure stage 45 when the high-pressure stage 45 operate in "motor" mode. This constitutes a decisive advantage relative to pressure amplifiers based on slide valves or ports respectively actuated or uncovered mechanically by the double-acting medium-pressure piston 3. In fact, this mode of operation of the converter 1 in accordance with the invention prevents all undesirable return of oil into the medium-pressure inlet-outlet circuits 15 or the high-pressure inlet-outlet circuits 16 or the medium-pressure chambers 6 or the high-pressure chambers 11. Furthermore, said mode of operation prevents any leaks between the various medium-pressure inlet-outlet circuits 15 or between the various high-pressure inlet-outlet circuits 16, and, generally speaking, any unnecessary loss of energy.

This strategy for controlling the operation of the reversible hydraulic pressure converter 1 in accordance with the present invention employing tubular valves with its computer for controlling the converter 19 also enables regular operation of said converter 1 so that—for example—the flow of oil at the pump inlet 47 and/or at the pump outlet 48 is as constant and as regular as possible.

It is also necessary to underline the decisive advantage that the tubular valves 12 procure when they consist—as shown in FIGS. 3 to 8—of a rectilinear tube 20. In fact, this configuration makes it possible to obtain a high flow of oil between the contact flange 34 and the closure seat 27 without it being necessary for the valve actuator 13 to produce a high force to move the rectilinear tube 20.

Note further that the section of the tube cylinder 24 may advantageously be slightly smaller than the section of the annular contact formed between the contact flange 34 and the closure seat 27 so that the pressure in the annular internal chamber 22 tends to press the contact flange 34 against said seat 27 when said pressure is greater than that in the balancing passage 32.

In accordance with this principle, the contact flange 34 forms a good seal with the closure seat 27, just like the tube cylinder 24 forms a satisfactory seal with the rectilinear tube 20.

Thus, as FIGS. 3 to 8 show, a coil 29 of conductive wire consuming low electrical power can attract a magnetic core or armature 30 providing the valve actuator 13, even if the tubular valve 12 operates at particularly high-pressures, which may be up to two thousand bar and more.

FIGS. 3 to 5 illustrate the operation of the tubular valve 12 when the tubular valve 12 is "normally closed". FIG. 3 shows said valve 12 at rest, its contact flange 34 remaining held in contact with the closure seat 27 by the closure spring 28.

As shown in FIG. 4, when an electrical current flows through the coil 29 of conductive wire, the conductive wire attracts the magnetic core or armature 30 which—via the force applied to the rectilinear tube 20 by said core 30—lifts the contact flange 34 off the closure seat 27, which allows the oil under pressure contained in the annular internal chamber 22 to escape toward the rectilinear tube inlet-outlet orifice 35. This action is still controlled by the control computer of the converter 19.

As FIG. 5 shows, when the pressure in the rectilinear tube inlet-outlet passage 38 is greater than the pressure in the annular internal chamber 22, the floating plate 33 that with the valve casing 21 constitutes a check valve is lifted off its plate seat 39 so as to allow the oil contained in the rectilinear tube inlet-outlet passage 38 to enter the annular internal chamber 22.

This variant of the tubular valve 12 the operation of which is shown in FIGS. 3 to 5 is particularly suitable for the high-pressure stage 45, provided that the inlets and outlets are connected correctly as shown in FIG. 1.

The variant of the tubular valve 12 the operation of which is shown in FIGS. 6 and 7 is "normally open". FIG. 6 shows said valve 12 at rest, its contact flange 34 remaining away from the closure seat 27 with which it cooperates via the closure spring 28. In this position, oil can circulate freely between the annular internal chamber 22 and the rectilinear tube inlet-outlet orifice 35.

As shown in FIG. 7, when an electrical current flows through the coil 29 of conductive wire, the conductive wire attracts the magnetic core or armature 30 which—via the force that the the magnetic core or armature 30 applies to the rectilinear tube 20—presses the contact flange 34 onto the closure seat 27, which prevents oil from circulating between the annular internal chamber 22 and the rectilinear tube inlet-outlet orifice 35. Once again, this action is still controlled by the control computer of the converter 19.

This latter variant of the tubular valve 12 the operation of which is shown in FIGS. 6 and 7 is particularly suitable for the medium-pressure stage 44, the inlets and outlets being connected correctly as shown in FIG. 1 so that the floating plate 33 can never function as a check valve.

In all cases the variant of the tubular valve 12 shown in FIG. 8 prevents the floating plate 33 operating as a check valve. In this variant, said plate 33 is in fact always held pressed onto its plate seat 39 by the pressure in the annular internal chamber 22 and/or in the balancing chamber 31 because of the vent orifice 17.

In accordance with this configuration, the floating plate 33 remains free to center the closure seat 27 relative to the contact flange 34 when there is no pressure in said chambers 22, 31, thanks to the force produced by the closure spring 28 on said flange 34, whereas in operation, radial or axial movement of said plate 33 is rendered impossible by the force produced by the pressure in said chambers 22, 31 on said plate 33 because no antagonistic pressure is applied at the level of the vent orifice 17.

It must be understood that the foregoing description has been given by way of example only and in that it is no way limiting on the scope of the invention, replacing the details of execution described by any other equivalent not departing therefrom.

The invention claimed is:

1. A reversible hydraulic pressure converter (1) employing tubular valves, comprising:

a medium-pressure stage (44) consisting of a medium-pressure cylinder (2) each of the two ends of which is closed by a medium-pressure head (4) and in which can move in translation in a fluid-tight manner a double-acting medium-pressure piston (3) that has a pressure face (5) facing each medium-pressure head (4) while said medium-pressure cylinder (2), said heads (4) and said pressure faces (5) form two medium-pressure chambers (6) axially positioned on respective opposite sides of the double-acting medium-pressure piston (3);

at least one high-pressure stage (45) consisting of a piston connecting rod (7) for each pressure face (5), said rod (7) being fastened to the double-acting medium-pressure piston (3) and to a high-pressure piston (8), said rod (7) passing in a fluid-tight manner through the medium-pressure head (4) so as to extend into a high-pressure cylinder (9) the diameter of which is smaller than that of the medium-pressure cylinder (2), while the high-pressure piston (8) can move in translation in a fluid-tight manner in the high-pressure cylinder (9), the high-pressure cylinder (9) being closed by a high-pressure head (10) so as to constitute with said high-pressure piston (8) a high-pressure chamber (11);

at least one tubular valve (12) for each medium-pressure chamber (6) adapted to place the medium-pressure chamber (6) in communication with a medium-pressure inlet-/outlet circuit (15), said valve (12) cooperating with an independent valve actuator (13);

at least one tubular valve (12) for each high-pressure chamber (11) adapted to place the high-pressure chamber (11) in communication with a high-pressure inlet-outlet circuit (16), said valve (12) being adapted to be actuated to be opened or closed by an independent valve actuator (13);

at least one piston position sensor (14) that can transmit to a control computer (19) of the converter the position of the double-acting medium-pressure piston (3) or the position of any of the high-pressure pistons (8), the tubular valve (12) includes at least one rectilinear tube (20) hollowed out in the axial direction to form a balancing passage (32), said at least one rectilinear tube (20) being accommodated with a small clearance in a tube cylinder (24) to constitutes a seal, and said at least one rectilinear tube (20) being movable in longitudinal translation in said tube cylinder (24), the tube cylinder (24) being mounted on or disposed in a valve casing (21) inside which is provided an annular internal chamber (22) into which discharges an annular chamber inlet-outlet orifice (23) that communicates with an annular chamber inlet-outlet passage (37), said tube cylinder (24) discharging into said annular internal chamber (22), the annular internal chamber (22) including a closure seat (27) opposite and coaxial with said tube cylinder (24), while the at least one rectilinear tube (20) has on the one hand a first end (25) located in the annular internal chamber (22) and terminated by a contact flange (34) that can come into annular contact with the closure seat (27) externally of the balancing passage (32) so as to constitute a seal with said seat (27)

and on the other hand a second end (26) that discharges into a balancing chamber (31) and is mechanically connected to the valve actuator (13), the balancing passage (32) establishing communication between the closure seat (27) and the balancing chamber (31).

2. The reversibly hydraulic pressure converter (1) employing tubular valves according to claim 1, wherein the balancing passage (32) communicates with a rectilinear tube inlet-outlet orifice (35) that communicates with a rectilinear tube inlet-outlet passage (38) at the center of the closure seat (27) and passes through the closure seat (27) axially, said rectilinear tube inlet-outlet orifice (35) being located inside the annular contact that the contact flange (34) makes with the closure seat (27).

3. The reversibly hydraulic pressure converter (1) employing tubular valves according to claim 1, wherein the balancing passage (32) communicates with a rectilinear tube inlet-outlet orifice (35) that discharges into the balancing chamber (31).

4. The reversibly hydraulic pressure converter (1) employing tubular valves according to claim 3, wherein the at least one rectilinear tube (20) includes at least one radial inlet-outlet passage (36) disposed radially in said at least one rectilinear tube (20) and the first end of which discharges into the balancing passage (32) while a second end discharges into the balancing chamber (31).

5. The reversibly hydraulic pressure converter (1) employing tubular valves according to claim 1, wherein a closure spring (28) cooperates with the at least one rectilinear tube (20) to hold the contact flange (34) in contact with the closure surface (27).

6. The reversibly hydraulic pressure converter (1) employing tubular valves according to claim 1, wherein a closure spring (28) cooperates with the at least one rectilinear tube (20) to hold the contact flange (34) at a certain distance from the closure surface (27).

7. The reversibly hydraulic pressure converter (1) employing tubular valves according to claim 1, wherein the valve actuator (13) includes a coil (29) of conductive wire that attracts a magnetic core or armature (30) when an electrical current passes through said coil (29), said core or armature (30) being fastened directly or indirectly to the second end (26) of the at least one rectilinear tube (20).

8. The reversibly hydraulic pressure converter (1) employing tubular valves according to claim 7, wherein the coil (29) of conductive wire is accommodated inside the balancing chamber (31).

9. The reversibly hydraulic pressure converter (1) employing tubular valves according to claim 7, wherein the coil (29) of conductive wire is accommodated outside the balancing chamber (31), the magnetic field generated by said coil (29), when an electrical current passes through said coil (29), passing through the external wall of said balancing chamber (31) so as to exert a force on the magnetic core or armature (30).

10. The reversibly hydraulic pressure converter (1) employing tubular valves according to claim 1, wherein the contact flange (34) is a truncated sphere and has a line of contact with the closure seat (27).

11. The reversibly hydraulic pressure converter (1) employing tubular valves according to claim 1, wherein the closure seat (27) is on a floating plate (33) free to align radially with the contact flange (34) when the contact flange (34) comes into contact with the closure seat (27) while said plate (33) bears in a fluid-tight manner on a plate seat (39) in the valve casing (21).

12. The reversibly hydraulic pressure converter (1) employing tubular valves according to claim 11, wherein the balancing passage (32) communicates with a rectilinear tube inlet-outlet orifice (25) that communicates with a rectilinear tube inlet-outlet passage (38) at the center of the closure seat (27) and passes through the closure seat (27) axially, said rectilinear tube inlet-outlet orifice (35) being located inside the annular contact that the contact flange (34) makes with the closure seat (27), and wherein the floating plate (33) constitutes with the valve casing (21) a check valve that can open when the pressure in the rectilinear tube inlet-outlet passage (38) is greater than the pressure in the annular internal chamber (22), said floating plate (33) otherwise bearing in a fluid-tight manner on the plate seat (39).

13. The reversibly hydraulic pressure converter (1) employing tubular valves according to claim 1, wherein a section of the annular contact formed between the contact flange (34) and the closure seat (27) is greater than a corresponding section of the tube cylinder (24).

14. The reversibly hydraulic pressure converter (1) employing tubular valves according to claim 1, wherein a check valve (40) is mounted in parallel with the tubular valve (12) and on the same circuit (15, 16).

15. The reversibly hydraulic pressure converter (1) employing tubular valves according to claim 11, wherein the balancing passage (32) communicates with a rectilinear tube inlet-outlet orifice (35) that discharges into the balancing chamber (31), and further comprising a vent orifice (17) that passes axially through the said plate seat (39).

* * * * *